US005176438A

United States Patent [19]

Fisherman

[11] Patent Number: 5,176,438

[45] Date of Patent: Jan. 5, 1993

[54] INTEGRAL CLIPBOARD AND READING LIGHT

[75] Inventor: Carl Fisherman, Franklin Lakes, N.J.

[73] Assignee: Photo Audio Consumer Electronics Marketing Corp., New York, N.Y.

[21] Appl. No.: 800,275

[22] Filed: Nov. 29, 1991

[51] Int. Cl.[5] ..... A47B 19/00

[52] U.S. Cl. ..... 362/99; 362/198; 362/382

[58] Field of Search ..... 362/98, 99, 33, 97, 362/157, 194, 197, 198, 199, 382

[56] References Cited

U.S. PATENT DOCUMENTS

| | | | |
|---|---|---|---|
| 1,889,373 | 11/1932 | Pereira | 362/99 |
| 2,732,681 | 1/1956 | King | 362/98 |
| 4,680,681 | 7/1987 | Fisherman et al. | 362/98 |
| 4,751,620 | 6/1988 | Wright et al. | 362/99 |

*Primary Examiner*—Stephen F. Husar

*Attorney, Agent, or Firm*—Ezra Sutton

[57] ABSTRACT

The present invention relates to a clipboard and reading light and is directed to a simple, inexpensive, compact, and portable device for lighting the reading surface of a clipboard.

11 Claims, 4 Drawing Sheets

INTEGRAL CLIPBOARD AND READING LIGHT

FIELD OF THE INVENTION

The present invention relates to an integral clipboard and reading light and, more particularly, is directed to a simple, inexpensive, compact, and portable device for lighting up the reading surface of the clipboard.

BACKGROUND OF THE INVENTION

Although clipboards are well known, they are difficult to use at night or in dark areas. Clipboards do not have lights built in to them for lighting up the reading surface when needed.

Broadly, it is an object of the present invention to provide a combination of a clipboard and reading light which overcomes the aforesaid drawbacks of the prior art. Specifically, it is within the contemplation of the present invention to provide an improved device which is simple to use and store, inexpensive, convenient, compact, portable, and which accommodates all types of clipboards.

It is a further object of the present invention to provide a combination of a clipboard and reading light which is combined into a compact and portable arrangement but yet allows the reading light to be extended over the reading surface of the clipboard so that the user can more easily focus the light where desired.

It is a still further object of the present invention to provide an improved arrangement which is easy to use and which is easy to store, since the operation of extending the reading light out of the battery container automatically operates to turn on the reading light, and storage is easily accomplished, since it is only necessary to return the reading light to the battery compartment which automatically turns off the reading light.

SUMMARY OF THE INVENTION

Briefly, in accordance with the principles of the present invention, there is provided an improved integral clipboard and reading light which includes a first side for receiving and holding paper and the like and a second side. An elongated housing is mounted on the second side and includes a first compartment for receiving batteries arranged in parallel to a second compartment for receiving a supporting arm for a reading light. The supporting arm and reading light are disposed for movement relative to the second compartment between an open position in which the supporting arm extends out of the second compartment and a closed position in which the supporting arm is disposed within the second compartment. In addition, the reading light is movably mounted relative to the supporting arm for directing light in different directions, as desired by the user.

In the preferred embodiment, the reading light includes a reflector, and the reflector forms the upper portion of the housing, so that in the closed position, the reflector functions as a closure to close off one end of the housing and the first and second compartments.

In addition, in the preferred embodiment, metal contacts are provided on the inside of the housing and on the lower end of the supporting arm. In this manner, when the supporting arm is moved to its closed position, the contacts are disengaged, and the reading light is automatically turned off, and the device is ready for transport or storage. To operate, the supporting arm is moved out of the housing to its extended position, and the contacts on the supporting arm come into engagement with the contacts on the housing to automatically turn on the reading light and render the device ready for use.

Advantageously, as a result of the invention, there is provided an improved device which is easy to use and easy to store. The simple operation of extending the supporting arm and reading light renders the device ready for use, and the simple operation of retracting the supporting arm into the housing turns off the light and renders the device ready for storage.

BRIEF DESCRIPTION OF THE DRAWINGS

Further objects, features, and advantages of the present invention will become apparent upon the consideration of the detailed description of the presently-preferred embodiment when taken in conjunction with the accompanying drawings, wherein.

DESCRIPTION OF THE PREFERRED EMBODIMENT

Figure 1:
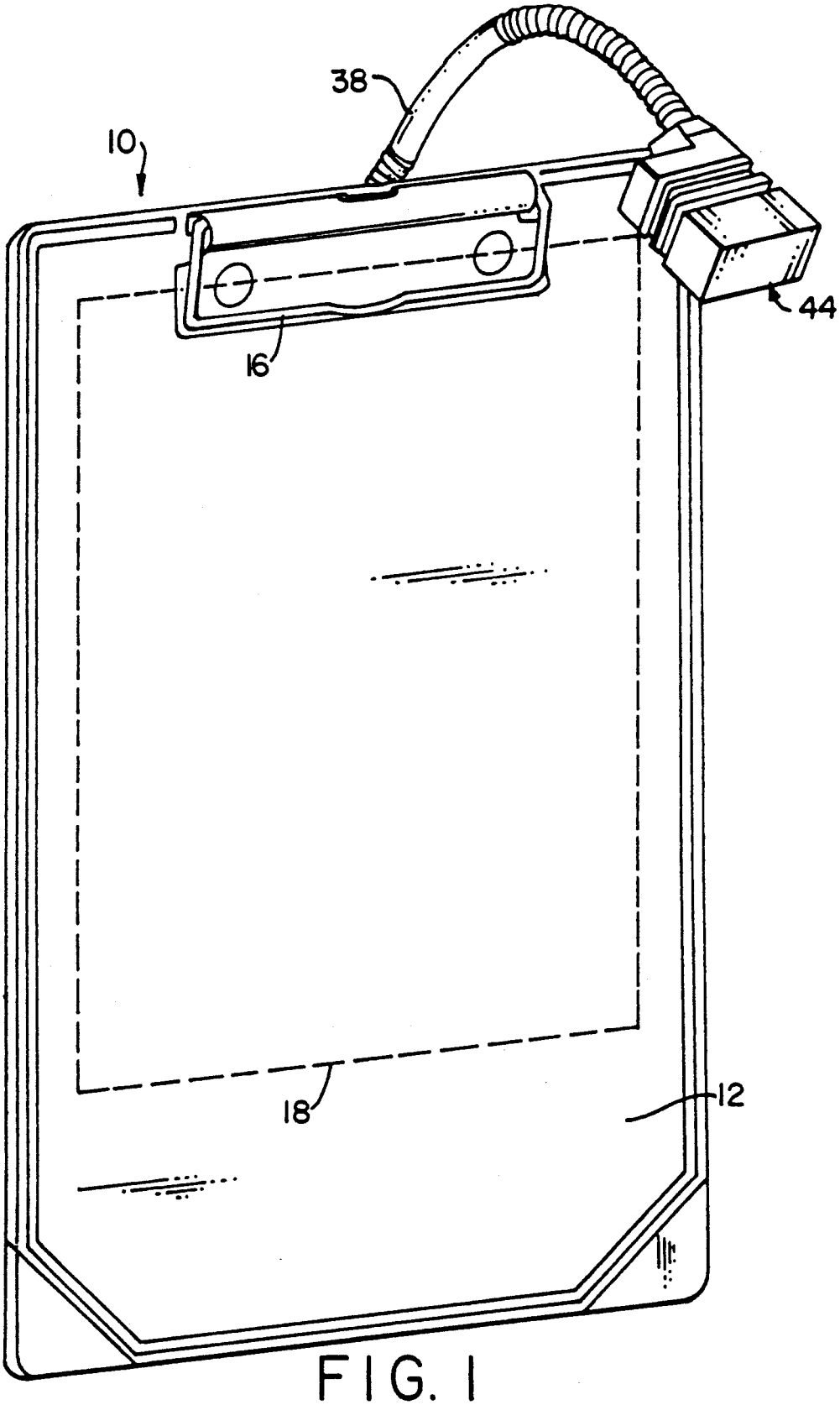
FIG. 1 is a perspective view of the integral clipboard and reading light illustrating the reading light and supporting arm in its extended position.
Figure 2:
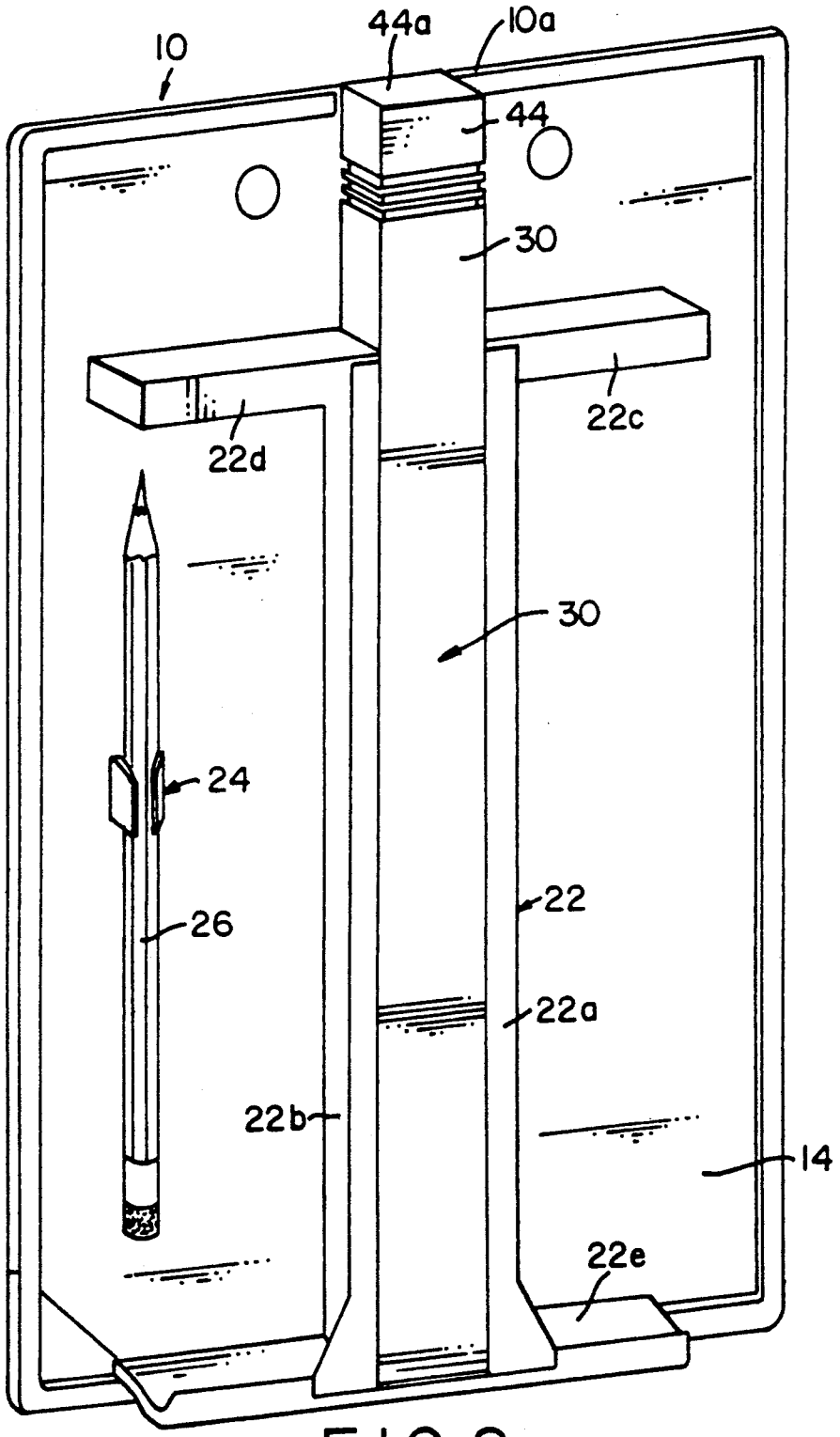
FIG. 2 is a rear perspective view.
Figure 3:
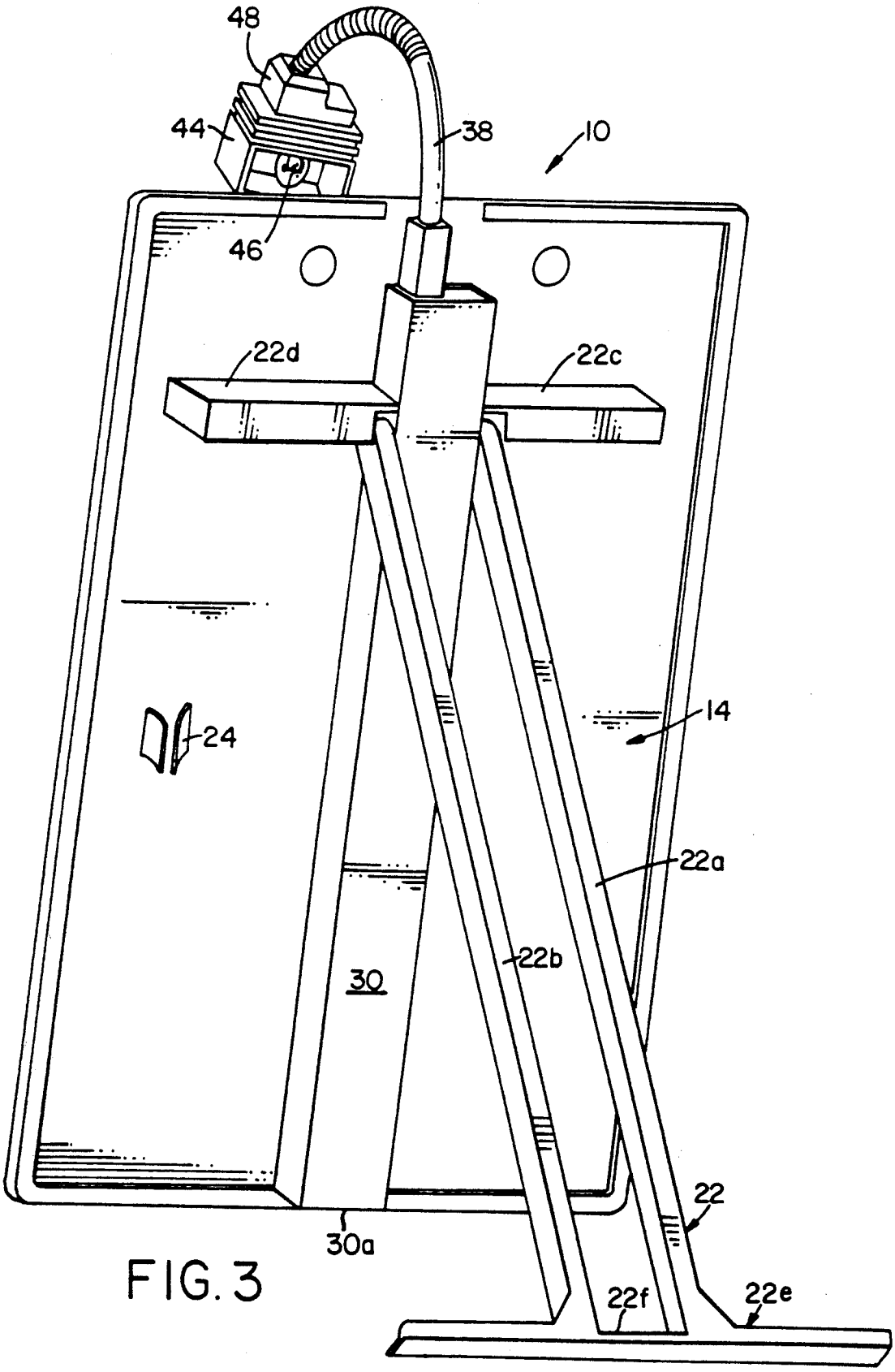
FIG. 3 is a rear perspective view with the supporting stand in its extended position.
Figure 4:
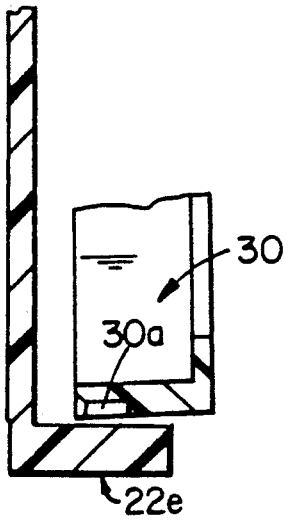
FIGS. 4 and 5 show how the supporting stand is held in position.
Figure 5:
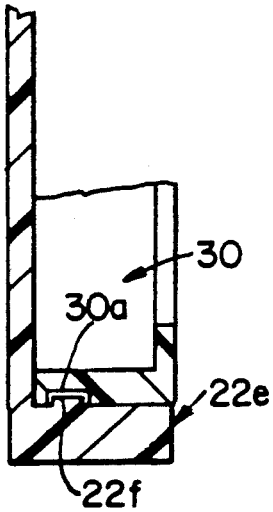

FIGS. 1 to 3 illustrate the lighted clipboard 10 of the present invention. The clipboard 10 includes a reading surface 12, a rear surface 14, and a spring clip 16 mounted on the reading surface 12 for holding paper 18 and the like in place, as is well known.

The rear surface 14 has mounted thereon a movable supporting stand 22, a pencil holder 24 for a pencil 26, and a housing 30. The movable supporting stand 22 is movable between a first position in engagement with rear surface 14 and a second position shown in FIG. 3 in which the stand 22 is in its extended position to support the clipboard 10 in an upright position on a flat surface. The stand 22 includes leg members **22*a* and 22*b* pivotally attached to cross members 22*c* and 22*d*, mounted on rear surface 14, and a horizontal surface-engaging member 22*e*. As shown in FIG. 2, legs 22*a* and 22*b* are spaced to straddle housing 30, and horizontal member 22*e* is positioned to engage the bottom surface 30*a* of housing 30. A protrusion 22*f* is formed on member 22*e* for engaging a recess 30*a* formed on the bottom of housing 30, so that stand 22 is releasably held in engagement with housing 30 and rear surface 14** when it is not in use.

Figure 6:
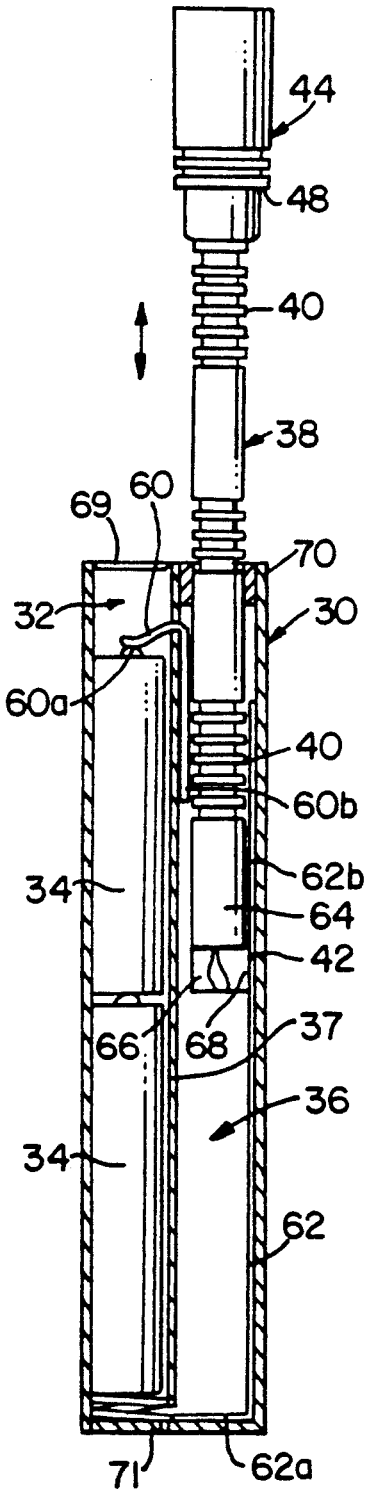
FIG. 6 illustrates the interior of said housing.

The clipboard and reading light 10 of the present invention is made of any suitable material, such as plastic. As shown in FIG. 6, the housing 30 includes a first compartment 32 for receiving batteries 34, a second compartment 36 for receiving a supporting arm 38, a wall 37 separating the two compartments, and a reflector housing 44, and 36 are rectangular in cross section but can be of any suitable configuration, such as semicircular. Compartment 32 is closed at the top by a cap 69 and is openable at the bottom by a door 71 for changing batteries 34. Compartment 36 includes a collar member 70 at its top through which arm 38 moves in and out of the compartment.

As shown in FIG. 6, the supporting arm 38 includes sections 40 which are flexible and bendable, so that the arm can be moved or adjusted to any desired position over the reading surface 12 of clipboard 10. Arm 38 also includes a stop member 42 at the lower end of the arm for engaging collar member 70 to limit how far arm 38 may be extended. The reflector housing 44 is connected to the upper end of the arm 38 and encloses a light bulb 46. In this manner, the reflector housing 44 concentrates the light from light bulb 46 downwardly towards the reading surface 12. The supporting arm 38 and reflector 44 are disposed for movement relative to compartment 36 between an open position (shown in FIG. 3) in which the supporting arm 38 extends out of the compartment 36 and a closed position (shown in FIG. 2) in which the supporting arm 38 is completely disposed within the compartment 36. In addition, the reflector housing 44 is pivotally mounted by collar 48 on supporting arm 38 for pivoting reflector housing 44 and light bulb 4 in different directions, as desired during use.

As shown in FIGS. 2 and 3, the compartments 32 and 36 are slightly shorter than the clipboard 10. Thus, the top surface of compartments 32 and 36, together with housing 30, define a space adapted to receive reflector housing 44 when it is moved into its closed position to close off the upper ends of compartments 32 and 36 and to close housing 30, so that the device may be easily and compactly stored. In addition, as shown in FIG. 2, the top surface 44*a* of the reflector housing, in its closed position, is coplanar with or coextensive with the top edge 10*a* of the clipboard 10. As shown in FIG. 2, the width of reflector housing 44 is also equal to the width of housing 30. Accordingly, in this manner, when reflector housing 44 is moved to its closed position, it forms a continuation of the elongated housing 30 and functions as a closure to close off the open end of compartment 36 and also protects bulb 46 from damage when not in use.

Referring to FIG. 6, there is shown the automatic switching arrangement of the present invention. More particularly, battery compartment 32 includes a metal contact 60 mounted at its upper end, which extends into compartment 36 and includes one end 60*a* for contact with batteries 34 and a second end 60*b* for contact with elongated arm 38, in a manner to be explained. In addition, housing 30 includes an elongated L-shaped metal contact 62 disposed therein, which has one end 62*a* connected to the bottom of batteries 34 and an upper end 62*b* for contact with arm 38, in a manner to be explained. Arm 38 houses an electrical wire 64 connected to light bulb 46 and which extends down through the length of supporting arm 38 to metal contacts 66 and 68 mounted on stop member 42. As supporting arm 38 moves in and out relative to compartment 36, metal contact 68 always remains in engagement with metal contact 62. Thus, it is only when metal contact 66 is brought into engagement with metal contact 60*b* that the electrical circuit is completed and operates to turn on light bulb 46. This occurs when supporting arm 38 is moved in an upward direction within compartment 36 to its extended position. Arm 38 is prevented from being removed from compartment 36 by stop member 42 engaging collar 70 disposed at the top of compartment 36. When the arm 38 is retracted into compartment 36, and reflector housing 44 closes housing 30, the electrical contact between contact 66 and 60*b* is broken, and the light is automatically turned off.

Thus, in accordance with the present invention, the simple step of extending or retracting the supporting arm 38 operates to automatically turn on or off the light bulb 46. It is simple and convenient for the user to move the device to its operating position for use or to move the device to its closed position for storage and transport. In addition, a compact and portable arrangement is provided when reflector housing 44 is moved to its closed position. It is only necessary to make sure the reflector housing 44 is turned 90 degrees when moved to its closed position to line up with housing 30. Further, since arm 38 is flexible and bendable, when it is in the extended position, the light bulb 46 can be adjusted to focus on the reading surface 12, or merely be held in any desired position over the clipboard 10. Still further, since reflector housing 44 is rotatable or pivotable relative to arm 38, this further enhances the capability of directing light as desired by the user. As a further advantage, when the reflector housing is in its closed position, the light bulb 46 is completely enclosed and protected by rear surface 14 and thus is not susceptible to being damaged.

Advantageously, as a result of the various embodiments of the present invention, there has been provided an improved integral clipboard and reading light which is simple to use, inexpensive, compact, portable, and safe.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope and of the invention herein.

What is claimed:

1. A clipboard and reading light comprising:

a clipboard having a first side for receiving and holding paper and the like and a second side;

an elongated housing mounted on said second side and including a first compartment for receiving batteries and a second compartment for receiving a supporting arm for a reading light;

said supporting arm being disposed for sliding movement relative to said second compartment between an open position in which said supporting arm slides to a position where it extends out of said second compartment and a closed position in which said supporting arm is slidably retracted to a position within said second compartment; and said reading light being movably mounted relative to said supporting arm for directing light in different directions.

2. A clipboard and reading light in accordance with claim 1, wherein said reading light includes a reflector and wherein said reflector forms a part of said housing.

3. A clipboard and reading light in accordance with claim 2, wherein said reflector in the closed position functions as a closure to close one end of said housing and also functions to turn off said reading light automatically.

4. A clipboard and reading light in accordance with claim 1, wherein said first compartment and said second compartment are arranged in parallel relative to each other in said housing, said second compartment being of sufficient length to completely receive said supporting arm within said second compartment when said supporting arm is moved to said closed position.

5. A clipboard and reading light in accordance with claim 1, wherein said first and second compartments are shorter in length than said clipboard, and said reflector, in said closed position, closes off said compartments.

6. A clipboard and reading light in accordance with claim 5, wherein the top surface of said reflector, in said closed position, is substantially coplanar with the top edge of said clipboard.

7. A clipboard and reading light in accordance with claim 1, wherein said supporting arm is collapsed telescopically.

8. A clipboard and reading light in accordance with claim 1, wherein said supporting arm is flexible and bendable.

9. A clipboard and reading light in accordance with claim 1 further including switching means for automatically turning said reading light on and off.

10. A clipboard and reading light in accordance with claim 9, wherein said switching means includes a first contact on said supporting arm and a second contact in said housing, said first contact being moved out of engagement with said second contact when said supporting arm is moved to said closed position to turn off said light, and said first contact being moved into engagement with said second contact when said supporting arm is moved to said open position to turn on said light.

11. A clipboard and reading light in accordance with claim 1 further including means for supporting said clipboard in an upright position.

* * * * *

UNITED STATES PATENT AND TRADEMARK OFFICE

CERTIFICATE OF CORRECTION

PATENT NO. : 5,176,438

DATED : January 5, 1993

INVENTOR(S) : Carl Fisherman

It is certified that error appears in the above-identified patent and that said Letters Patent is hereby corrected as shown below:

Column 2, line 59, after "44," insert --for a purpose to be explained. As will be noted, compartments 32--.

Column 3, line 16, change "4" to --46--.

Signed and Sealed this

Second Day of November, 1993

*Attest:*

Bruce Lehman

BRUCE LEHMAN

*Attesting Officer*

*Commissioner of Patents and Trademarks*